United States Patent [19]

Davis

[11] 4,298,133

[45] Nov. 3, 1981

[54] INTEGRAL TRAY AND COVER WITH SNAP LOCK

[75] Inventor: Paul Davis, Swampscott, Mass.

[73] Assignee: Sweetheart Plastics, Inc., Wilmington, Mass.

[21] Appl. No.: 67,935

[22] Filed: Aug. 20, 1979

[51] Int. Cl.[3] ..... B65D 6/34; B65D 43/10; B65D 43/14

[52] U.S. Cl. ..... 220/306; 220/74; 220/339; 229/2.5 R

[58] Field of Search ..... 220/306, 74, 339, 337; 229/2.5 R; 264/321

[56] References Cited

U.S. PATENT DOCUMENTS

| | | | |
|---|---|---|---|
| 3,001,665 | 9/1961 | Tomarin | 220/4 B |
| 3,303,964 | 2/1967 | Luker | 229/2.5 X |
| 3,452,896 | 7/1969 | Elliot | 220/306 |
| 3,620,411 | 11/1971 | Rump | 229/2.5 X |
| 3,633,785 | 1/1972 | Cyr et al. | 229/2.5 X |
| 3,675,811 | 7/1972 | Artz | 229/2.5 X |
| 3,684,633 | 8/1972 | Haase | 264/321 X |
| 4,132,344 | 1/1979 | Jewell | 229/2.5 R |

*Primary Examiner*—Allan N. Shoap

*Attorney, Agent, or Firm*—Wolf, Greenfield & Sacks

[57] ABSTRACT

A foam plastic disposable tray and cover typically used for take-out dinners at fast food establishments. The tray and cover are joined by an integral hinge along one side edge. At a location remote from the hinge, tabs and undercut tab seats are formed in the tray and cover respectively that releasably latch the cover in a closed position on the tray.

5 Claims, 5 Drawing Figures

INTEGRAL TRAY AND COVER WITH SNAP LOCK

INTRODUCTION

This invention relates to food containers and more particularly comprises a disposable plastic container of the type used in fast food establishments for take out dinners and the like.

Disposable food containers by definition must be inexpensive, and manufacturers are always seeking ways to reduce their cost of manufacture. This is particularly important with the spiraling costs of raw materials. In the manufacture of containers having hinged covers and trays, the formation of latching facilities to releasably lock the covers in the closed position adds considerably to the problems of manufacture and can adversely affect the production costs. For example, many of such containers formed from foam plastic sheet material include tabs and slots on the container parts, and the slotting operation which takes place at the trim press after forming requires very accurate registration of the foam sheet and the cutting dies to achieve an acceptable product. Many containers are formed in the sheet during each cycle of the forming machine, and the spacing between the groups of containers made in successive cycles is very critical.

The principal object of the present invention is to provide a latching facility for foam plastic food containers that does not impose during manufacture the critical registration requirements of other types of latches.

Another object of this invention is to provide a latching device for foam plastic food containers, which is self engaging when the cover is closed, and which automatically aligns the cover and tray without separate pressing or flexing to achieve proper registration when the container is closed.

Another general object of this invention is to provide a disposable foam plastic container having an integral tray and cover, which is inexpensive to manufacture, sanitary and convenient to use.

To accomplish these and other objects, the container of this invention includes a tray and cover made of a foam plastic material with an integral hinge joining the two parts along one side thereof. On one or more corners of the tray and cover remote from the hinge, tabs are provided on one part and undercut tab seats are provided on the other, which engage one another when the container is closed to latch the tray and cover together. The containers are free of slots at the latching facility to minimize manufacturing problems.

BRIEF FIGURE DESCRIPTION

DETAILED DESCRIPTION

Figure 1:
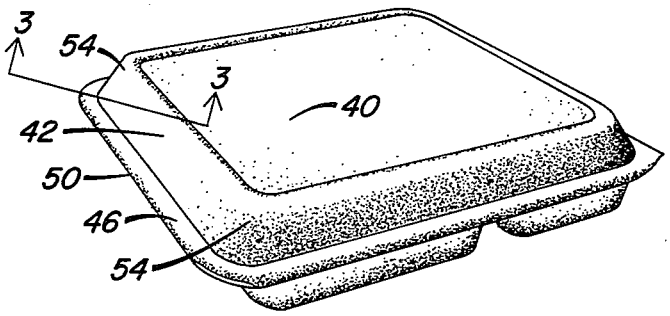
FIG. 1 is a perspective view of one embodiment of a closed food container constructed in accordance with the present invention.
Figure 2:
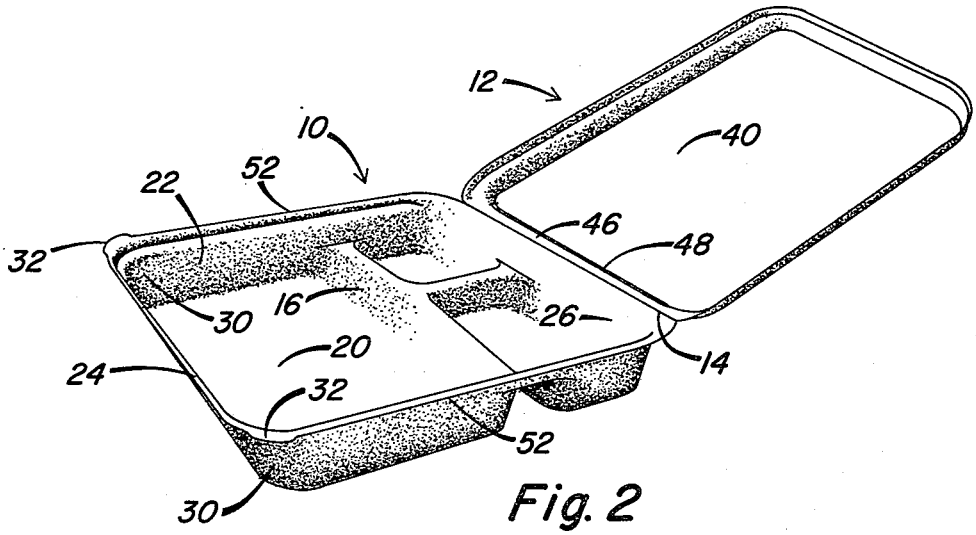
FIG. 2 is a perspective view similar to FIG. 1 but showing the container in the open position.

The embodiment of food container shown in the drawings includes a tray 10 and cover 12, both generally rectangular in plan view and integrally formed with one another and joined by the hinge 14. The tray 10 in the embodiment shown includes a T-shaped partition 16 that divides the tray into sections. A food container of this configuration is frequently used for take-out dinners in fast food establishments; the larger compartment in the tray may be used for the main course while the two smaller compartments may be used for vegetables, salads, fruit, etc. Both the tray 10 and cover 12, including the hinge 14, are made of a foam plastic material, typically styrene, and of the sheet material from which the container is formed may typically have a preformed density of approximately 6 lbs./cu. ft. That density may increase slightly during the formation of the container.

Tray 10 is provided with a bottom wall 20 and an upwardly and outwardly extending side wall 22 that describes the depth of the tray about the four sides of the bottom wall. About the top of side wall 22 is an outwardly extending generally horizontal flange 24 (hinge 14 joins the flange at the rear portion 26 of side wall 22). The taper of the side wall 22 is sufficiently large so as to allow identical containers to form a natural nest with one another without sticking together. That is, the flare is such that the parts will not wedge together when nested and make it difficult to separate them.

At the two corners 30 of the tray and extending outwardly from the outer edges of the flange 24 are a pair of tabs 32 that form part of the latching means for the container. The tabs 32 are generally horizontally oriented, and they diverge from one another at an angle of approximately 120°. Each tab is positioned at a 30° angle with respect to the line of hinge 14. The tabs 32 are in the same plane as the flange 24 and essentially form an extension of the flange at the two corners remote from hinge 14.

Cover 12 includes a top wall 40 and a peripheral side wall 42 which generally correspond in size to bottom wall 20 and side wall 22 of the tray. Actually in the embodiment shown the area of the top wall 40 is slightly greater than that of the bottom wall 20 so that identical closed containers can be stacked on top of one another. To stabilize the upper container in such a stack, the top wall 40 has a bead 44 formed about its periphery where it joins the side wall 42. The bead 44 prevents the upper container placed on top of the cover from sliding laterally off top wall 40.

The flare of the side wall 42 is generally the same as that of the side wall 22 of the tray, and it enables covers of identical containers to nest closely with one another without binding. An outwardly extending flange 46 is provided about the lower edge of side wall 42, which flange overlies the flange 24 on the tray when the cover is in the closed position as shown in FIG. 1. Hinge 14 joins the flange 46 at the rear wall 48 of the tray. A downwardly extending skirt 50 is provided about three sides of flange 46 (excepting only the side which includes hinge 14), and the skirt covers the outer edge 52 of the flange 24 of tray 10 when the cover is closed so as essentially to fully enclose the flange 24 and provide a sanitary closure for the container.

At the corners 54 of the cover, in skirt 50, undercut tab seats 56 are formed that releasably engage the edges of the tabs 32 in the tray so as to lock the cover closed.

Figure 5:
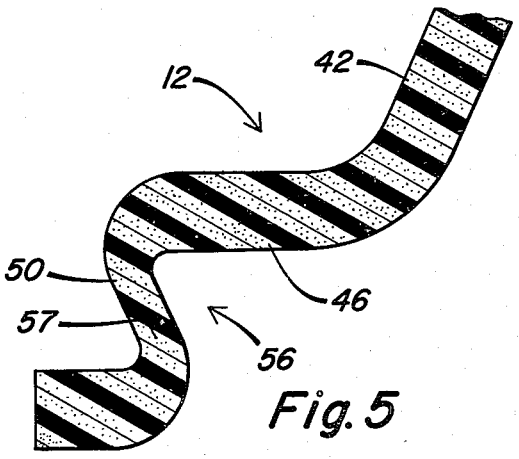
FIG. 5 is an enlarged fragmentary cross-sectional view of one corner of the cover.

As is evident in FIG. 5, in the region 57 of the undercut tab seats 56, the thickness of the foam material is reduced by compressing the sheet material in those locations. The reduced thickness of the sheet material produces a corresponding increase in the density of the material, which in turn increases both the strength and stiffness of the skirt. This makes a more effective latch for the container.

Figure 3:
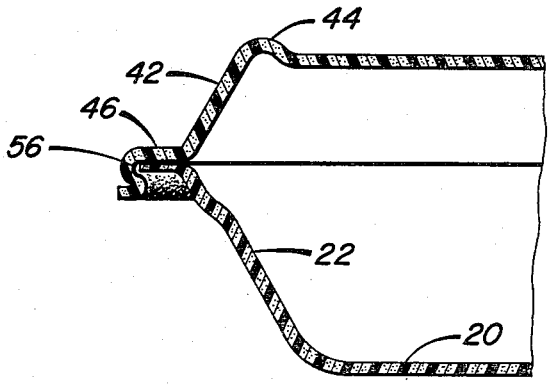
FIG. 3 is an enlarged fragmentary cross-sectional view taken along section line 3—3 of FIG. 1, showing one of the two locking devices provided at the corners of the container to releasably maintain the cover in the closed position.
Figure 4:
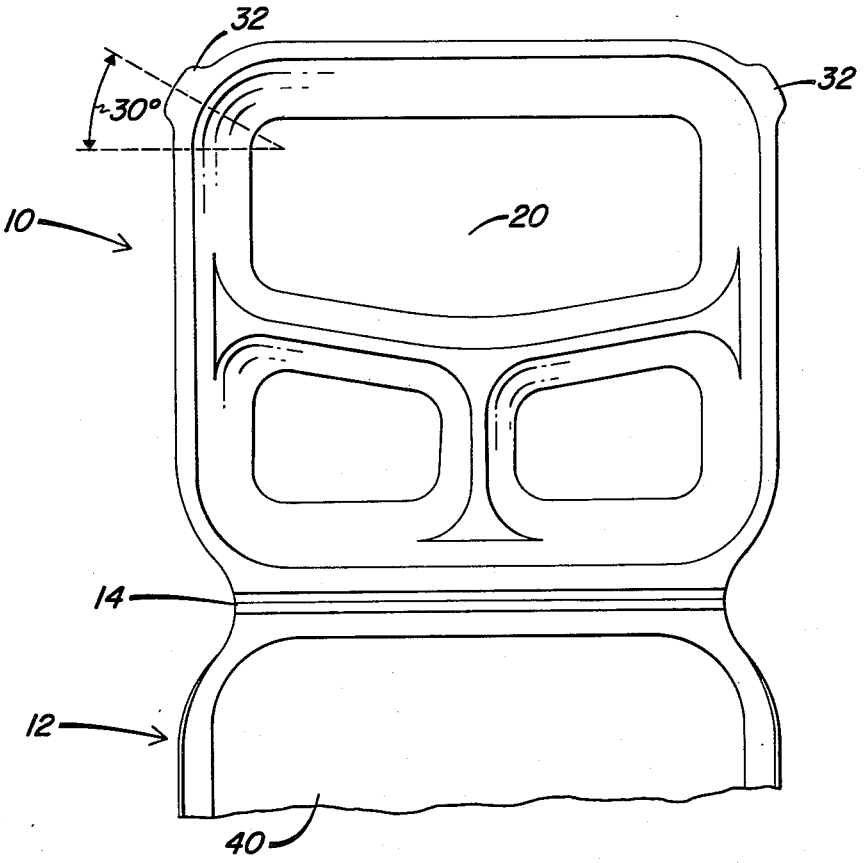
FIG. 4 is a plan view of the tray of the food container.

The thickness of the foam sheet material at tabs 32, as shown in FIG. 3, is also less than other portions of the container. This creates a greater density and consequently greater strength and stiffness at the tabs. Not only does this provide a better latch for the container but it also enables the container to be trimmed from the sheet more effectively. It will of course be appreciated that in normal manufacture, many containers are formed in the sheet simultaneously, and after formation each container is trimmed from the sheet leaving a web which is subsequently reground so that the material may be used again.

It should be noted that the latching devices provided for the container at the two corners remote from the hinge are free of slots that would require very accurate registration of the formed sheet at the trim press which separates the individual containers from the sheet. If slots were provided at the latching facilities the spacing between successive groups of containers formed in the sheet would be critical. But the use of the undercuts at the two corners, as taught in the present invention, eliminates the critical control which would be necessary with slots. Therefore, the latching device of the present invention is particularly beneficial in the manufacturing operation. And the use of latches at both corners makes it easier to achieve proper registration between the tray and cover when the container is closed.

The fact that the tabs extend more nearly parallel than perpendicular to the hinge 14 reduces the effect upon the latching device of registration error during trimming. It will be appreciated that any error which occurs will have only negligable effect upon the distance between the ends of the tabs and the hinge, and therefore the tabs will snap properly into the undercut tab seats without binding and will also securely hold the container closed. On the other hand, if the tabs were nearly perpendicular to the hinge, any registration error would substantially alter that distance and adversely affect the latch operation.

Because modifications may be made of this invention without departing from its spirit, it is not intended to limit the scope of this invention to a single embodiment illustrated and described. Rather, the scope of this invention is to be determined by the appended claims and their equivalents.

What is claimed is:

1. A foam plastic disposable food container comprising:

a generally rectangular bottom tray and cover integrally formed with one another of foam plastic and joined together along a common side edge that defines a hinge on one side of the tray and cover allowing the cover to pivot on the tray from a closed position wherein the cover lies on top of the tray to an open position wherein the cover is substantially coplanar with and disposed beside the tray, said tray having a bottom wall and an upstanding, outwardly flared peripheral side wall about the four sides of the bottom wall, said cover having a top wall and a depending downwardly flared peripheral side wall about the four sides of the top wall, an outwardly extending flange about the upper edge of the side wall of the tray on each of the other three sides of the bottom wall to which the cover is not hinged, and an outwardly extending flange about the lower edge of the side wall of the cover and overlying the flange on the tray when the cover is closed, a skirt extending downwardly from the outer edge of the flange on the cover and covering the outer edge of the flange on the tray, tabs formed at two adjacent corners of the tray remote from the hinge and lying in the plane of and forming extensions of the flange on the tray, said tabs extending away from each other at the same angle with respect to an imaginary line parallel to the hinge, and undercut tab seats formed on the corners of the cover corresponding to the corners carrying the tabs on the tray, said seats receiving the tabs at the corners to releasably lock the cover closed.

2. A foam plastic disposable food container as defined in claim 1 further characterized by said tabs extending away from each other at approximately an angle of 120° and forming an angle of 30° with respect to the hinge.

3. A foam plastic disposable food container as defined in claim 1 further characterized by the skirt being thinner and more dense at the region of the undercut tab seats than in other regions of the skirt to provide greater strength and stiffness at the seat.

4. A foam plastic disposable food container as defined in claim 2 further characterized by the skirt being thinner and more dense at the region of the undercut tab seats than in other regions at the remainder of the skirt to provide greater strength and stiffness at the seat.

5. A foam plastic disposable food container comprising:

a bottom tray and cover integrally formed with one another and joined together along a common side edge that defines a hinge on one side of the tray and cover allowing the cover to pivot on the tray from a closed position wherein the cover lies on top of the tray to an open position wherein the cover is substantially coplanar with and disposed beside the tray, said tray having a bottom wall and an upstanding peripheral side wall about the sides of the bottom wall, said cover having a top wall and a depending peripheral side all about the sides of the top wall, an outwardly extending flange about the upper edge of the side wall of the tray and an outwardly extending flange about the lower edge of the side wall of the cover and overlying the flange on the tray when the cover is closed, a skirt extending downwardly from the outer edge of the flange on the cover and covering the outer edge of the flange on the tray, at least one tab formed on the tray remote from the hinge and forming an extension of the flange on the tray in the same plane as said flange, said tab being thinner and more dense than the side wall of the tray for greater strength and stiffness, and an undercut tab seat formed on the cover and aligned with the tab on the tray when the cover is closed, the top of said seat defined by the outwardly extending flange of the cover, said seat receiving the tab to releasably lock the cover closed, said skirt being thinner and more dense at the region of the undercut tab seat than in other regions to provide greater strength and stiffness at the seat, said tab and seat being at an acute angle with respect to the hinge.

* * * * *